US007111579B2

(12) United States Patent
Bailey et al.

(10) Patent No.: US 7,111,579 B2
(45) Date of Patent: Sep. 26, 2006

(54) APPARATUS COMPRISING A SHIP-TO-SHORE INTERFACE

(75) Inventors: Stephen L. Bailey, Los Gatos, CA (US); Lewis D. Madden, Morgan Hill, CA (US); Steven J. Schmitz, Sr., Sunnyvale, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/948,039

(22) Filed: Sep. 23, 2004

(65) Prior Publication Data

US 2006/0060128 A1 Mar. 23, 2006

(51) Int. Cl.
*B63B 17/00* (2006.01)

(52) U.S. Cl. ..... 114/362

(58) Field of Classification Search ..... 114/263, 114/343, 362; 405/219; 14/71.1, 69.5
See application file for complete search history.

(56) References Cited

U.S. PATENT DOCUMENTS

| | | | | |
|---|---|---|---|---|
| 3,687,308 | A * | 8/1972 | Apelstrand et al. | 14/71.1 |
| 4,337,545 | A * | 7/1982 | Rose et al. | 14/71.1 |
| 5,340,267 | A * | 8/1994 | Stoll et al. | 14/71.1 |
| 6,067,926 | A * | 5/2000 | Robinson | 114/362 |
| 6,536,064 | B1 * | 3/2003 | Swink et al. | 14/69.5 |
| 6,739,279 | B1 * | 5/2004 | Funk | 114/362 |

* cited by examiner

*Primary Examiner*—Lars A. Olson
(74) *Attorney, Agent, or Firm*—DeMont & Breyer, LLC

(57) ABSTRACT

A ship-to-shore interface includes a shipside ramp and a shoreside ramp. The shoreside ramp is securely fixed to the shoreline. The shoreside ramp has one or more physical adaptations that enable it to passively engage the shipside ramp. In the illustrative embodiment, the physical adaptation is a plurality of recesses that receive a lug that depends from the shoreside end of the shipside ramp.

15 Claims, 3 Drawing Sheets

APPARATUS COMPRISING A SHIP-TO-SHORE INTERFACE

FIELD OF THE INVENTION

The present invention relates to a shoreline interface for transferring passengers, troops, vehicles, and the like between a ship and a shore facility.

BACKGROUND OF THE INVENTION

There are a variety of situations in which passengers, troops, or vehicles must be transferred from a ship to a shoreline or vice versa. Examples of vessels that engage in this operation include roll-on/roll-off vehicle ferries and naval logistics support vessels.

The transfer requires a device that holds the ship near the shoreline and some way for passengers, vehicles, etc. to offload or onload. Offloading and onloading is typically performed using a ramp. The ramp and the holding/stabilizing device are collectively referred to as an "interface." Usually, some portion of the interface is carried by the ship ("the shipside interface") and some portion is located on the shore ("the shoreside interface").

The interface must maintain vessel position and yaw angle during offloading and onloading operations. And it must permit the vessel to resist wave, current and wind forces while accommodating pitch and heave due to tides and the transfer of vehicles.

The conventional approach to the ship-to-shore interface has been to provide a simple vehicle ramp on the shipside and to construct elaborate shoreside facilities to guide, position, and hold the vessel to the shore. But this approach has several drawbacks.

In particular, having an elaborate shoreside facility equates to high harbor infrastructure costs. Furthermore, extensive shoreside interface facilities can have a deleterious impact on the surrounding environs. For military applications, landing forces are often required to rapidly offload on unimproved or semi-improved beachheads. For such applications, an elaborate shoreside facility is not possible.

As a consequence, there is a need for an interface that is capable of creating a temporary connection between a ship and a shoreline that:

- is mechanically simple on both the shipside and the shoreside; and
- is capable of controlling vessel surge, sway, roll, and pitch.

SUMMARY OF THE INVENTION

The illustrative embodiment of the present invention is a ship-to-shore interface that avoids some of the drawbacks of the prior art.

In accordance with the illustrative embodiment, the ship-to-shore interface comprises a shipside ramp and a shoreside ramp. The shoreside ramp is securely fixed to the shoreline. The shoreside ramp has one or more physical adaptations that enable it to passively engage the shipside ramp. In the illustrative embodiment, the physical adaptation is a plurality of recesses that receive a lug that depends from the shoreside end of the shipside ramp.

Most prior art ship-to-shore interfaces are necessarily expensive and complex because they include mechanisms, usually disposed on the shoreside, that are intended to guide, position, hold and interface a ship to the shoreline. The illustrative embodiment of the present invention is based on the inventors' recognition that the shipside ramp itself is an excellent mechanism for controlling a ship at the shoreline if an attachment can be made so that it can interface with the shore. In particular, by virtue of its structure, a ramp can geometrically constrain movement of the ship, as caused by wave, current, wind and tidal forces, using nothing more than the ship's thrust or ballasting subsystems.

Thus, in a ship-to-shore interface in accordance with the illustrative embodiment, a relatively more robust shipside ramp is used, in conjunction with the ship's thrust or ballasting subsystems, to position, hold and interface a ship to the shore. As a consequence, the shoreside facility is substantially simplified compared to prior-art ship-to-shore interfaces.

A ship-to-shore interface in accordance with the illustrative embodiment of the present invention provides the following benefits:

- Provides positional control of a ship relative to a shoreside ramp;
- Enables a ship to pitch and heave due to rotation at the lug;
- Prevents the ship from grounding over a wide range of tide;
- Dispenses with extensive shoreside facilities to stabilize the ship;
- Couples the shipside and shoreside ramps using vessel thrust and ramp deployment hydraulics thereby minimizing complicated infrastructure and manpower requirements; and
- Automatically decouples the shipside and shoreside ramps.

A ship-to-shore interface in accordance with the illustrative embodiment of the present invention comprises a passive shoreside ramp having a first feature; an active shipside ramp having a second feature, wherein the second feature is disposed at a shoreside end of the shipside ramp; and wherein the second feature reversibly couples to the first feature to physically restrain the vessel from moving away from the shoreside ramp.

DETAILED DESCRIPTION

Figure 1:
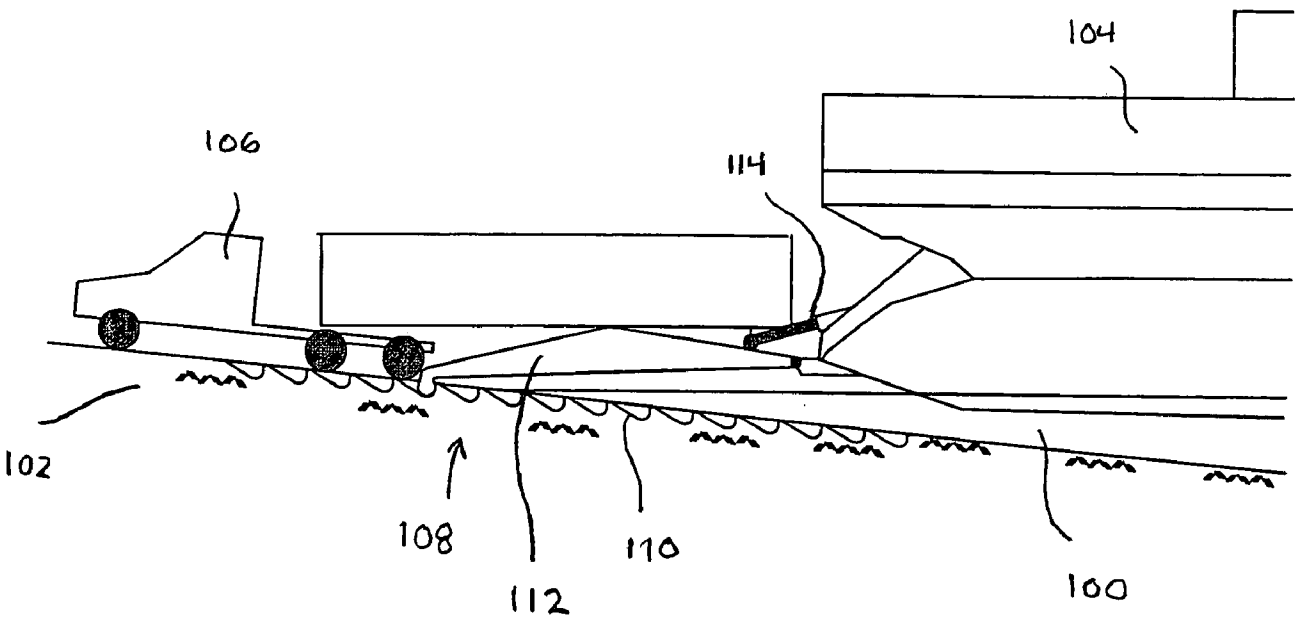
FIG. 1 depicts a ship-to-shore interface in accordance with the illustrative embodiment of the present invention.

FIG. 1 depicts ship 104 in water 100 near shoreline 102. The ship is coupled to shoreline 102 via ship-to-shore interface 108. FIG. 1 shows truck 106 being offloaded from ship 104 via the ship-to-shore interface.

Ship-to-shore interface 108 includes shoreside ramp 110 and shipside ramp 112, which detachably couple to one another. In the illustrative embodiment, shipside ramp 112 is "active."

As used herein to describe a ramp, the term "active" means that the ramp is movable to create the coupling between shoreside elements of the ship-to-shore interface and the shipside elements of the ship-to-shore interface. In the embodiment depicted in FIG. 1, shipside ramp 112 is moved by actuator 114. In some alternative embodiments, shipside ramp 112 is manually positioned, although this is only practical when shipside ramp 112 is relatively small.

On the other hand, in the illustrative embodiment, shoreside ramp 110 is "passive." As used herein to describe a ramp, the term "passive" means that the ramp is not moved to create the coupling between shoreside elements of the ship-to-shore interface and the shipside elements of the ship-to-shore interface. As described further below, in the illustrative embodiment, shoreside ramp 110 includes one or more physical adaptations that enables it to passively receive and reversibly couple to shipside ramp 112.

Figure 2:
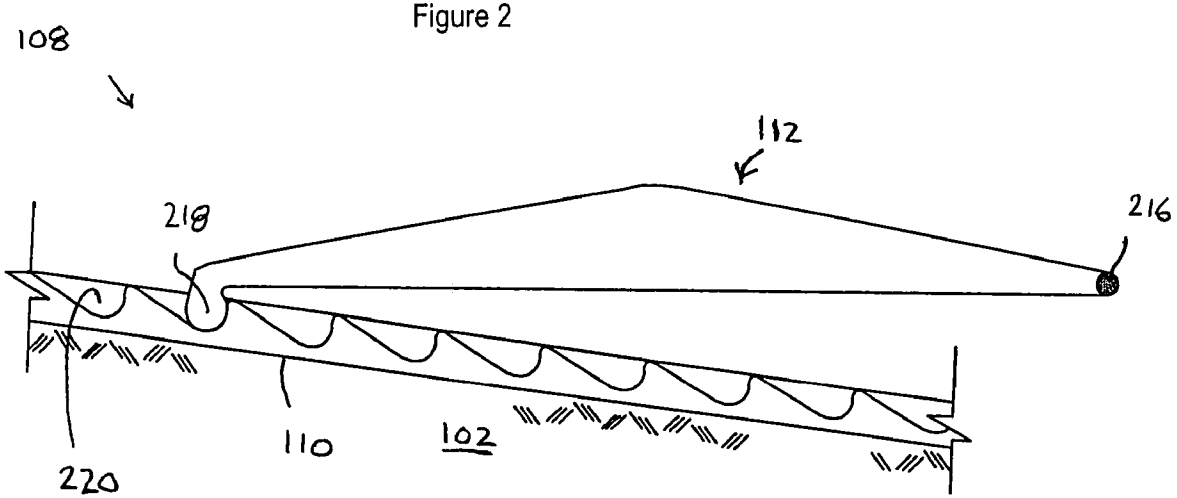
FIG. 2 depicts the ship-to-shore interface of FIG. 1.

FIG. 2 depicts further detail of ship-to-shore interface 108. In the illustrative embodiment, shipside ramp 112 is rotatably connected to ship 104 (not depicted in FIG. 2) at hinge 216. The hinge enables shipside ramp 112 to be rotated from a stowed position (for transit, etc.) to an engaged position in which it couples to shoreside ramp 110.

Figure 3:
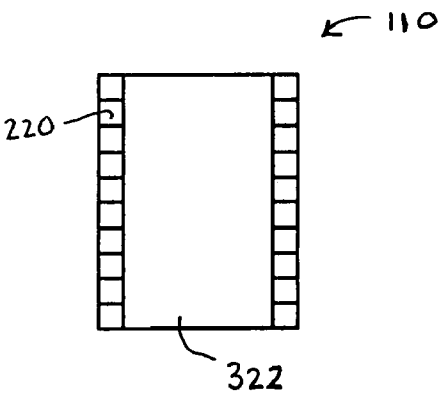
FIG. 3 depicts a top view of the shoreside ramp of the ship-to-shore interface of FIG. 2.

Shoreside ramp 110 is disposed on shoreline 102. In the illustrative embodiment, shoreside ramp 110 includes a plurality of recesses 220. The recesses are disposed along the side edges of the ramp. FIG. 3 depicts a top view of shoreside ramp 110, wherein recesses 220 flank flat-planar surface 322.

Recesses 220 in shoreside ramp 110 passively receive lugs 218 to create a reversible coupling between shipside ramp 112 and shoreside ramp 110. In the illustrative embodiment, two lugs 218 (only one lug is visible in the side view shown in FIG. 2) depend from the shoreside end of shipside ramp 112 to engage two spaced groups of recesses 220 (see FIG. 3).

The position and yaw angle of the ship must be maintained substantially constant during offloading and onloading operations. The ship must resist wave, current and wind forces while accommodating some pitch and heave adjustment due to tides and the movement of vehicles across shipside ramp 112.

Since the interface between shoreside ramp 110 and shipside ramp 112 is passive, the surge, sway, roll and pitch of ship 104 is controlled via a combination of the angle of shipside ramp 112 (relative to shoreline 102), the ship's thrust subsystem, or the ship's ballasting subsystem, all of which will geometrically constrain lugs 218 within recess 220. When the transfer of vehicles, personnel, etc., is complete, the ramp angle, thrust, or ballast is suitably varied to relax the coupling interface constraint, thereby enabling lugs 218 to decouple from recesses 220. For example, to relax the constraint, the ballast can be adjusted to cause ship 104 to float lower in water 100. Alternatively, assuming that a small amount of thrust is being applied to constrain lug 218 to recess 220, thrust can be cut.

Shipside ramp 112 is typically implemented as a metal grating, although other materials and structural arrangements can suitably be used. Lugs 218 are advantageously formed from a corrosion-resistant material. In some embodiments, lugs 218 are formed from or otherwise covered by a resilient material (e.g., a hard rubber, etc.).

In some embodiments, the shoreside ramp is formed by pouring a slab of concrete at the shoreline and then inserting, on both side edges of the slab, metal performs having wave-like crests and troughs (i.e., recesses). In some alternative embodiments, shoreside ramp 110 is two separate beams that have receptacles for receiving lugs 218. The beams are fixed to shoreline 102 in a spaced, parallel relationship to one another such that they present substantially the same "face" to lugs 218 as do recesses 220 of shoreline ramp 110 of FIGS. 2 and 3.

Shoreside ramp 110 can be a part of the permanently-installed infrastructure of a shoreside installation, or, as might be required for military operations, can be installed at the time of landing. In either case, shoreside ramp 110 is secured to the ground. In the case of a permanent installation, shoreside ramp 110 can be cemented to the shoreline. Alternatively, shoreside ramp 110 can be spiked to shoreline 102, which is suitable for both permanent and temporary installations. Other suitable alternatives for forming and securing shoreside ramp 110, as will occur to those skilled in the art, can suitably be used.

Figure 4:
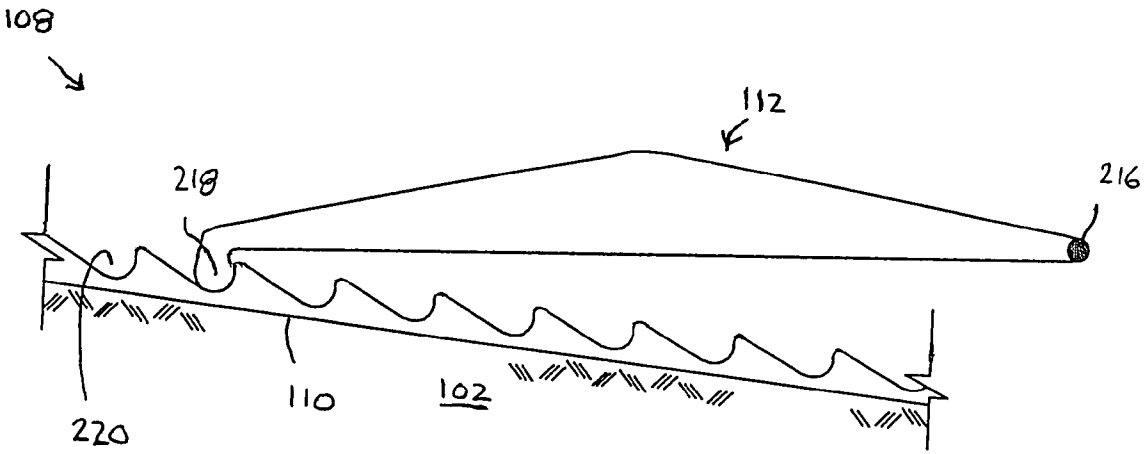
FIG. 4 depicts a variation of the shoreside ramp of the ship-to-shore interface of FIG. 2.

FIG. 4 depicts a variation of the illustrative embodiment in which recesses 220 are raised or elevated relative to the rest of shoreside ramp 110 or, in embodiments in which recesses 220 are formed in two spaced beams, the recesses are elevated relative to the shore itself. Since recesses 220 are raised, a single lug 218 that spans the width of the shipside ramp 112 can be used. Lug 218 is advantageously formed from a corrosion-resistant material. In some embodiments, lug 218 is formed from or otherwise covered by a resilient material (e.g., a hard rubber, etc.) to provide shock absorption and resilience.

Figure 5:
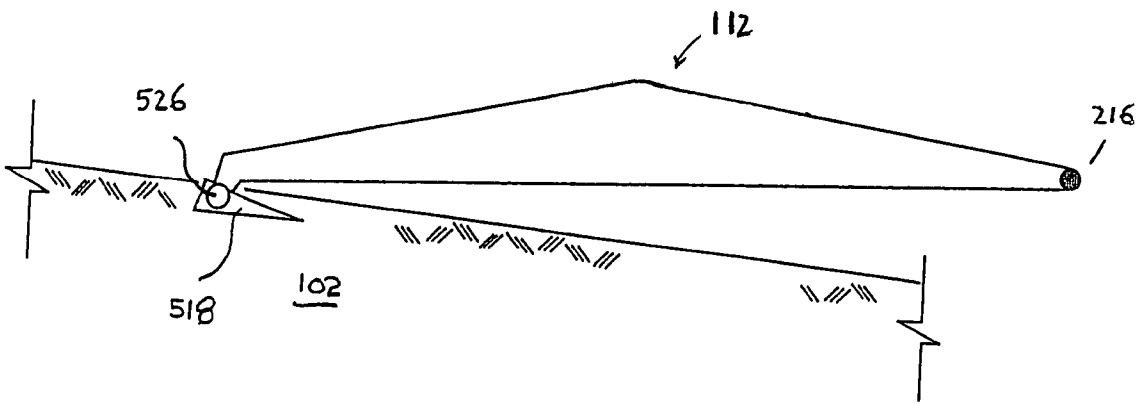
FIG. 5 depicts a variation of the shipside ramp of the ship-to-shore interface of FIG. 2.

FIG. 5 depicts yet an additional variation of the illustrative embodiment in which lug 218 is replaced by barb or fluke 518. In the embodiment that is depicted in FIG. 5, barb 518 is coupled to shipside ramp 112 by pivot 526. In this embodiment, shoreside ramp 110 is not required. Rather, barb 518 functions like an anchor and couples shipside ramp 112 directly to shoreline 102.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. A ship-to-shore interface comprising:

an active shipside ramp having a physical adaptation that, in conjunction with at least one of:

(a) ship's thrust subsystem;

(b) ship's shipside ramp-deployment subsystem; and (c) ship's ballasting subsystem; enables said shipside ramp to:

(i) couple to a passive shoreside ramp; and (ii) automatically decouple from said passive shoreside ramp.

2. The ship-to-shore interface of claim 1 wherein said physical adaptation further enables said ship side ramp to:

(iii) provide positional control of a ship relative to said passive shoreside ramp.

3. The ship-to-shore interface of claim 1 wherein said physical adaptation further enables said ship side ramp to:

(iv) allow said ship to pitch and heave.

4. The ship-to-shore interface of claim 1 wherein said physical adaptation comprises a lug, wherein said lug is received by said passive shoreside ramp.

5. The ship-to-shore interface of claim 4 further comprising said passive shoreside ramp.

6. The ship-to-shore interface of claim 5 wherein said passive shoreside ramp comprises a recess for receiving said lug.

7. The ship-to-shore interface of claim 5 wherein all of said shoreside ramp is supported by a shoreline such that no part of said shoreside ramp is floating.

8. A ship-to-shore interface comprising:

a shipside ramp, wherein said shipside ramo constrains movement of a ship usina at least one of ship's thrust subsystem and ship's ballastins subsystem; and a passive shoreside ramp, wherein said passive shoreside ramp:

(i) is a discrete structure that couples to a shoreline;

(ii) comprises a corrosion-resistant material; and (iii) possess a physical adaptation that enables said shoreside ramp to passively receive and passively detachably-couple to said shipside ramp that is maintained onboard said ship.

9. The ship-to-shore interface of claim 8 wherein said physical adaptation enables said shipside ramp to rotate about a location at which said shipside ramp couples to said shoreside ramp, such that an angle subtended between said shipside ramp and said shoreside ramp can vary.

10. The ship-to-shore interface of claim 8 wherein said shipside ramp comprises a lug at a shoreside end thereof, and wherein said physical adaptation of said shoreside ramp is a recess for receiving said lug.

11. The ship-to-shore interface of claim 8 wherein all of said shoreside ramp is supported by said shoreline such that no part of said shoreside ramp is floating.

12. A ship-to-shore interface comprising:

a passive shoreside ramp, wherein said passive shoreside ramp:

(i) is a discrete structure that couples to a shoreiine;

(ii) possess a physical adaptation that enables said shoreside ramp to passively receive and passively detachably-couple to a shipside ramp that is maintained onboard a ship;

(iii) in conjunction with said shipside ramp, constrains movement of a ship using at least one of ship's thrust subsystem and ship's ballasting subsystem; and (iv) is fully supported by a shoreline such that no part of said shoreside ramp is floating.

13. The ship-to-shore interface of claim 12 further comprising said shipside ramp.

14. The ship-to-shore interface of claim 12 wherein said physical adaptation enables said shipside ramp to rotate about a location at which said shipside ramp couples to said shoreside ramp, such that an angle subtended between said shipside ramp and said shoreside ramp can vary.

15. The ship-to-shore interface of claim 12 further comprising said shipside ramp, wherein said shipside ramp comprises a lug at a shoreside end thereof, and wherein said physical adaptation of said shoreside ramp is a recess for receiving said lug.

* * * * *